US008857453B2

(12) United States Patent
Souma

(10) Patent No.: US 8,857,453 B2
(45) Date of Patent: Oct. 14, 2014

(54) MOTOR-OPERATED UMBRELLA

(71) Applicant: Masaaki Souma, Haga-gun (JP)

(72) Inventor: Masaaki Souma, Haga-gun (JP)

( * ) Notice: Subject to any disclaimer, the term of this patent is extended or adjusted under 35 U.S.C. 154(b) by 21 days.

(21) Appl. No.: 13/890,310

(22) Filed: May 9, 2013

(65) Prior Publication Data

US 2013/0306118 A1 Nov. 21, 2013

(30) Foreign Application Priority Data

May 17, 2012 (JP) ..... 2012-113189

(51) Int. Cl.
*A45B 25/14* (2006.01)
*A45B 25/16* (2006.01)

(52) U.S. Cl.
CPC ..... *A45B 25/143* (2013.01); *A45B 25/165* (2013.01)
USPC ..... 135/20.3

(58) Field of Classification Search
CPC ..... A45B 25/14
USPC ..... 135/16, 20.3
See application file for complete search history.

(56) References Cited

U.S. PATENT DOCUMENTS

| | | | | |
|---|---|---|---|---|
| 5,141,010 | A * | 8/1992 | Muller et al. | 135/20.3 |
| 5,213,122 | A * | 5/1993 | Grady, II | 135/20.3 |
| 6,543,464 | B1 * | 4/2003 | Grady, II | 135/22 |
| 7,562,666 | B2 * | 7/2009 | Chan | 135/20.3 |
| 7,909,049 | B2 * | 3/2011 | Yang et al. | 135/20.3 |
| 7,997,290 | B2 * | 8/2011 | Stoelinga | 135/20.3 |
| 2004/0040591 | A1 * | 3/2004 | Ma | 135/908 |
| 2005/0166950 | A1 * | 8/2005 | Grady, II | 135/75 |
| 2006/0151019 | A1 * | 7/2006 | Lo | 135/20.3 |

FOREIGN PATENT DOCUMENTS

JP Hei-81996-103314 A 4/1996

* cited by examiner

*Primary Examiner* — Noah Chandler Hawk

(57) ABSTRACT

The structure of the motor-operated umbrella is made to degrease rotation damage caused by a motor and to be light weight of the umbrella for using easily by a hand.
A planetary gear mechanism consists of a sun gear, planetary gears and an internal gear that is arranged at border position between an upper middle shaft and a lower middle shaft, a lower end of a driving shaft inside the lower middle shaft is connecting to a motor rotating axle through a thrust bearing for transmitting a rotation of a motor, an upper end of the driving shaft is fixed to the sun gear, the outer cylinder is fitted with a cylindrical male thread is fixed to the internal gear, a male thread cover pipe is fitted with a supporting rib holder and an inner peripheral surface of the supporting rib holder is formed with a cylindrical female thread.

3 Claims, 10 Drawing Sheets

MOTOR-OPERATED UMBRELLA

BACKGROUND OF INVENTION

1. Field of Invention

This invention relates to an electric umbrella to be opened or closed under an operation of a motor.

2. Description of Related Art

"An automatically opening or closing umbrella" disclosed in the Cited reference 1 mentioned below that can be opening or closing under a rotation of a motor has been well known as the prior art.

The cited reference 1 has disclosed structure in which a screw member threadly engaged with a screw axle is restricted by a pin inserted from a groove opened at a supporting pole and is moved upward and downward when the screw axle inserted into a hollow supporting column (corresponding to a middle shaft) is rotated by a motor attached at a handle, a sliding member (corresponding to a parent rib holder) fixed to the pin moves a second rib member (corresponding to a supporting rib) upward or downward to open or close the umbrella.

PRIOR ART DOCUMENT

Patent Documents

Cited reference 1: Japanese Patent unexamined Publication No. 1996-103314

SUMMARY OF THE INVENTION

Problem to be Solved by the Invention

However, the invention described in the cited reference 1 shows probabilities that a high strength cannot be attained at the supporting pole due to a vertical long crack at the supporting pole caused by a groove into which a pin is inserted, and that the dusts or rain water enters the groove to cause the supporting pole to be rusted or troubled.

In addition, when the pin is moved upward or downward with the screw axle, the pin is pushed against the side surface of the groove to cause a high frictional resistance to occur and at the same time the screw member and the sliding member may easily show a lateral oscillation at their centers under a reaction of the pushed pin, resulting in that a smooth movement of the sliding member against this resistance, it becomes to need a battery and a powerful motor for generating a high voltage, resulting in that it should be required to make a large size of the handle.

Due to this fact, the weight of the entire umbrella exceeds an appropriate weight required as an umbrella held with a hand and the battery is consumed within a short active time due to heat generated there, so that a frequent replacement of the battery is required and it is expected that its practicability as usual life goods is damaged.

In order to resolve the problems in the prior art, it is an object of this invention to made an umbrella that can be easily opened or closed through an operation of a switch and its structure can be set the umbrella to be opened or closed with a slight power and thereby a replacement period of a battery required under a consumption of the electrical power is made as long as possible and at the same time the entire weight of the umbrella can be made light and its handling can be carried out even with a hand.

DISCLOSURE OF THE INVENTION

In claim 1 of the present invention, it is characterized that a motor-operated umbrella, wherein battery cells and a motor are installed at a space inside of a handle of an umbrella, and a changeover switch is arrangeed on electric wires for connecting the motor and the battery cells;

a middle shaft is divided into an upper middle shaft and a pipe-type lower middle shaft at a position that becomes slightly higher than that of a supporting rib holder under the full-opened state of the umbrella, a planetary gear mechanism comprising a central sun gear, the planetary gears around the sun gear and an internal gear outside the planetary gears is arranged at the divided position, an upper supporter is connected to the upper middle shaft and fixed to an upper part of a planetary carrier pole installed within the planetary gear mechanism, a lower supporter is connected to the lower middle shaft and fixed to a lower part of the planetary carrier pole installed within the planetary gear mechanism, and the upper middle shaft and the lower middle shaft are coaxial connected to each other to form a fixed shaft;

a driving shaft is inserted into the lower middle shaft, and a lower end of the driving shaft is connected to a motor rotating axle of the motor through a thrust bearing fixed to an upper part of the handle for transmitting a rotation of the motor, and at the same time an upper end of the driving shaft is fixed to the sun gear;

the internal gear is fixed to an outer cylinder, a cylindrical male thread covering an upper part of the lower middle shaft as if shield is fitted with a lower part of the outer cylinder, and an inner peripheral surface of the supporting rib holder is formed with a cylindrical female thread corresponding to the cylindrical male thread, and a male thread cover pipe having such a length as one covering entire of the cylindrical male thread is fitted with the supporting rib holder.

In Claim 2 of the present invention, it is characterized that the upper part of the lower middle shaft in a range covered by the cylindrical male thread is formed to have a smaller diameter than that of the lower part of the lower middle shaft.

In Claim 3 of the present invention, it is characterized that a battery cell space capable of storing spare battery cell is arranged at the handle of the umbrella and the spare battery cell is stored in the battery cell space.

The motor-operated umbrella of this invention is operated in such a way that when the switch is turned on, the driving shaft rotates the sun gear under a rotation of the motor connected to the battery cells to cause the internal gear to be rotated in an opposite direction of the motor's rotation.

Since the outer cylinder is fitted with the cylindrical male thread is fixed to the internal gear, when the internal gear is rotated, the cylindrical male screw is also rotated simultaneously, in this case, the supporting rib holder threadly engaged with the cylindrical male thread is supported immovably by the supporting ribs through the parent ribs, so that the supporting rib holder cannot be rotated but moves upward. As a result, the supporting ribs push up the parent ribs to cause the umbrella-sheet to be opened as the supporting rib holder reaches to the upper limit part and the umbrella is fully opened.

Then, when the switch is turned on its opposite side, a reverse rotation of the motor occurs is caused, and the cylindrical shape male thread also rotates in an opposite direction, resulting in that the supporting ribs pull down the parent ribs to cause the umbrella-sheet to be folded as the supporting rib holder reaches to the lower limit part and the umbrella is completely closed.

In this way, it becomes possible that the operation of the switch can open or close the umbrella.

The structure is made in such a way that the umbrella of opened or closed under action of the cylindrical male thread and the cylindrical female thread by a rotation of the driving shaft, so that opening or closing operation of the umbrella is stopped automatically if the switch is stopped intermittently, and the semi-open state of umbrella is kept and even it's opening or closing cannot be carried out ever.

As a result, if the umbrella is used for releasing to receive strong wind under its semi-open state due to receiving rain with strong wind, it does not need to hold the supporting rib holder with the other hand and it becomes possible to use the umbrella with only a hand.

In addition, a rotatory power of the motor is transmitted to from the motor rotating axle to the driving shaft, the cylindrical male thread is rotated through the driving shaft and the planetary gear mechanism to cause the supporting rib holder to move upward or downward. During this process, if a pitch of the cylindrical male thread is set small, it becomes possible to open or close the umbrella easily even if the rotatory power for the driving shaft is low. Due to this fact, it becomes possible to use the motor of which diameter size is small to be held easily at the handle.

In this case, since an axial load from the driving shaft is not transmitted directly to the motor rotating axle but received at a thrust bearing, a load against the rotation of the motor is reduced and it becomes possible to make a small sized formation of a battery or a motor.

As a result, it becomes possible to attain an entire light weight umbrella and to realize the motor-operated umbrella that can be easily handled even with a hand.

In addition, when the umbrella is fully opened, the male thread cover pipe is fitted with a lower part of the supporting rib holder covered the entire cylindrical male thread, and a hair or clothes rolling-in accident at the thread can be prevented and it become to improve safety of the umbrella.

Further, the sun gear, the planetary gears and internal gear can be assembled into one component, so an assembling work for an umbrella can be easily carried out if the component is applied.

In claim 2 of this invention, the upper part of the lower middle shaft in a range covered by the cylindrical male thread is formed to have the smaller diameter than the lower part of the lower middle shaft.

Then, a diameter of the cylindrical male thread is fitted to outside the upper part of the lower middle shaft and a diameter of the male thread cover pipe is fitted to further outside the cylindrical male thread to be further small size.

So that if an inner diameter of the male thread cover pipe and an outer diameter of the lower part of the lower middle shaft are set to such degrees as the male thread cover pipe can slid on the lower middle shaft, there occurs no irregular feeling such as a step feeling in an umbrella holding person.

In claim 3 of this invention, a battery cell space capable of storing spare battery cell is arranged at the handle, so even if the battery consumed during operation of opening or closing of the umbrella, the umbrella to be opened or closed completely by exchanging the consumed battery cell with the stored spare battery cell.

BEST MODE FOR CARRYING OUT INVENTION

An embodiment of this invention will be described as follows.

Figure 1:
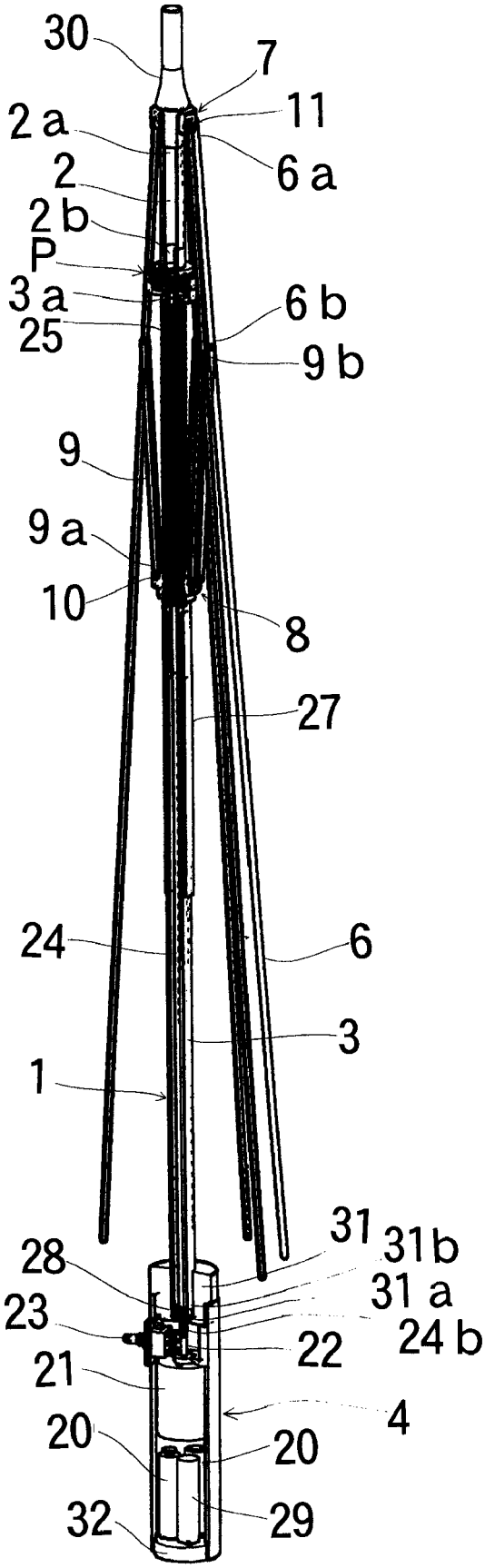
FIG. 1 is a longitudinal perspective view showing the closed state of motor-operated umbrella without the umbrella-sheet of the invention.

An umbrella of this invention relates to a European-style umbrella that represents an umbrella mainly used in rain, wherein as shown in FIG. 1, this umbrella comprises, in an order from the upper side of the middle shaft 1, a tip part 30 at the top, a parent rib holder 7 for use in fixing base ends 6*a* of the parent ribs 6, the supporting rib holder 8 for use in fixing base ends 9*a* of supporting ribs 9, and the handle 4 at the lower-most part.

Figure 6:
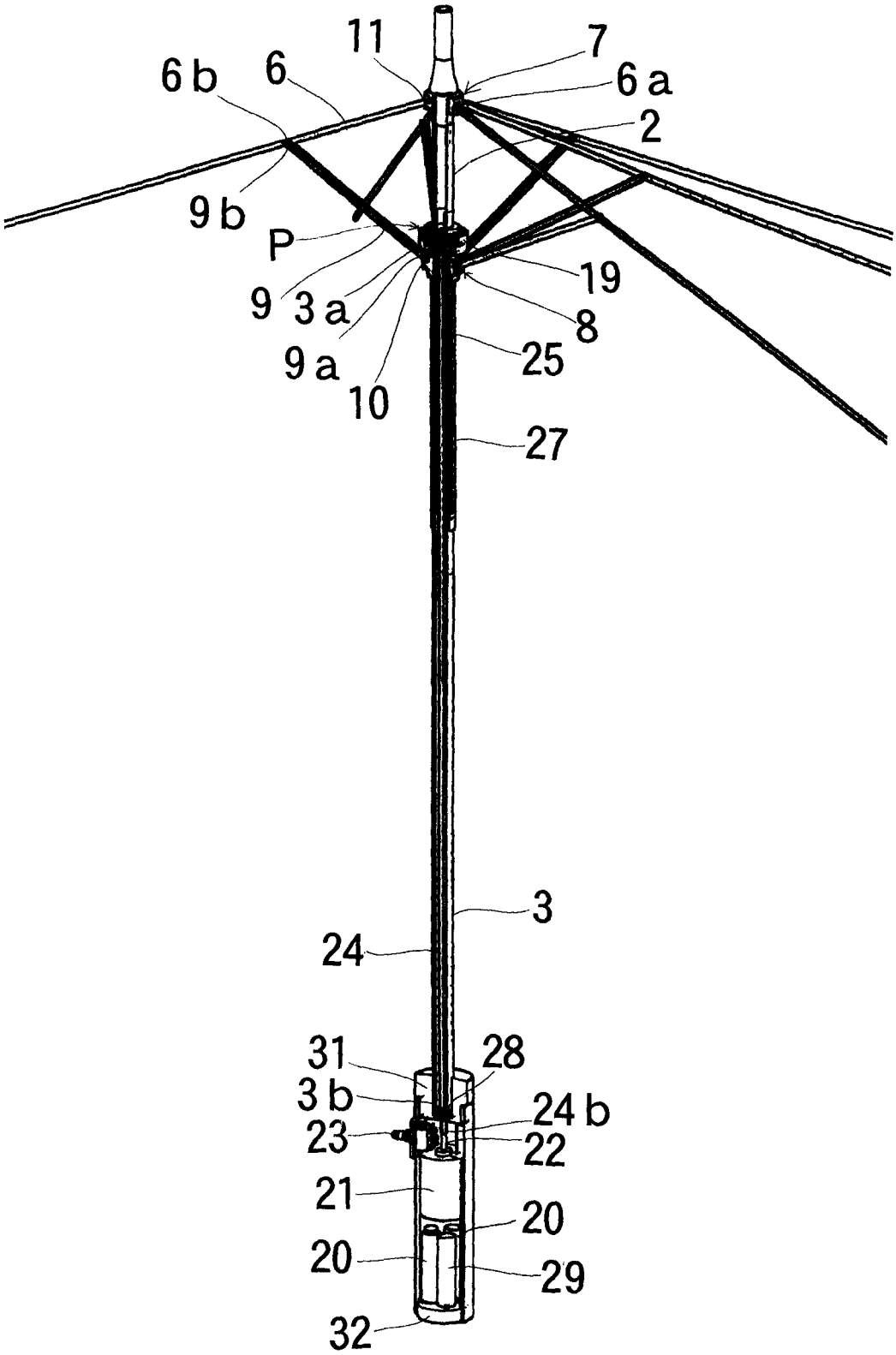
FIG. 6 is the longitudinal perspective view showing the opened state of motor-operated umbrella without the umbrella-sheet.

As shown in FIG. 6, parent rib joints 11 is made at the parent rib holder 7, each of the base ends 6*a* of the parent ribs 6 is slidably connected to the parent rib joints 11 in a radial manner. In addition, supporting rib joints 10 is made at the supporting rib holder 8, each of the base ends 9*a* of the supporting ribs 9 is slidably connected at to the supporting rib joints 10 in a radial manner. Then, central parts 6*b* of the parent ribs 6 is connected to end parts 9*b* of the supporting ribs 9 can slide together.

Figure 10:
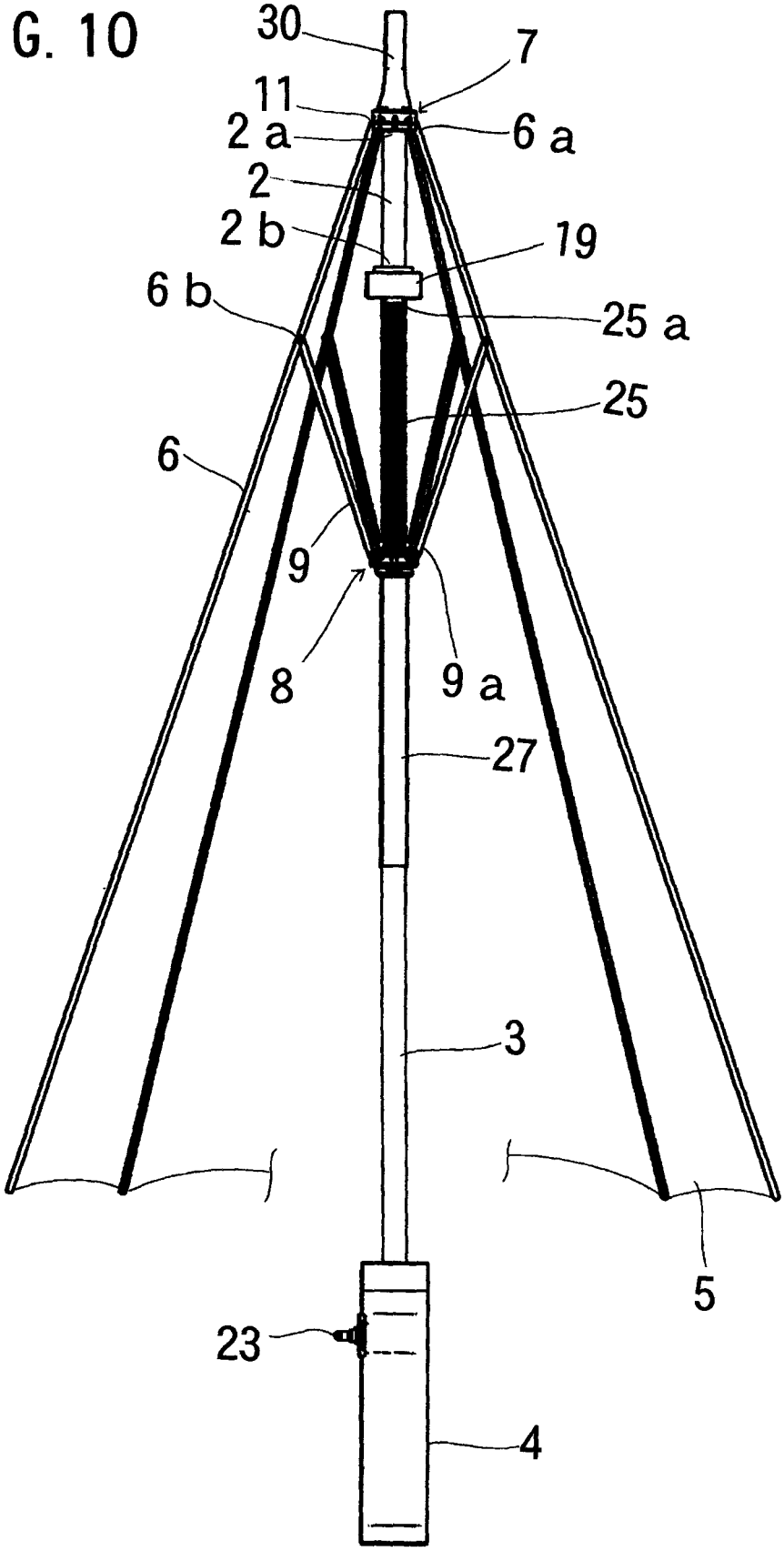
FIG. 10 is the longitudinal perspective view showing the half-opened state of motor-operated umbrella.

As shown in FIG. 10, the umbrella-sheet 5 such as clothes or synthetic resin sheet, etc. is applied in tension to the parent ribs 6 and the umbrella is opened under a state in which the clothes are tensioned from the circumference with a tension force when the umbrella is opened.

Opening or closing of the umbrella carried out by a movement of the supporting rib holder 8 installed to cover the lower middle shaft 3 in an upward or downward direction. When the supporting rib holder 8 is moved upward, the supporting ribs 9 push up the central parts 6*b* of the parent ribs 6 to cause the umbrella-sheet 5 to be opened, in turn, when the supporting rib holder 8 is moved downward, the supporting ribs 9 pull down the central parts 6*b* of the parent ribs 6 to cause the umbrella-sheet 5 to be folded.

This invention provides the aforesaid the umbrella as made in such a way that the supporting rib holder 8 can move upward and downward under the rotation of the motor 21 installed at the handle 4.

As shown in FIG. 1, its structure is made such that the handle 4 fixed to the lower end part of the middle shaft 1 is formed to have a space and the battery cells 20 and the motor 21 are stored in the space.

The battery cells 20 and the motor 21 are electrically connected through the switch 23 for use in changing over a forward rotation and a reverse rotation when a hand is released from the switch as the rotation of the motor is stopped. As the switch 23, a forward rotation or a reverse rotation changeover switch of 2-circuits and 3-poles type can be used.

Although the switch 23 is illustrated in FIG. 1 as a protruded-type switch, its shape is not restricted and if a switch can change over between the forward rotation and the reverse rotation of the motor 21, a button-type switch or a surface contact-type switch may be used.

Figure 4:
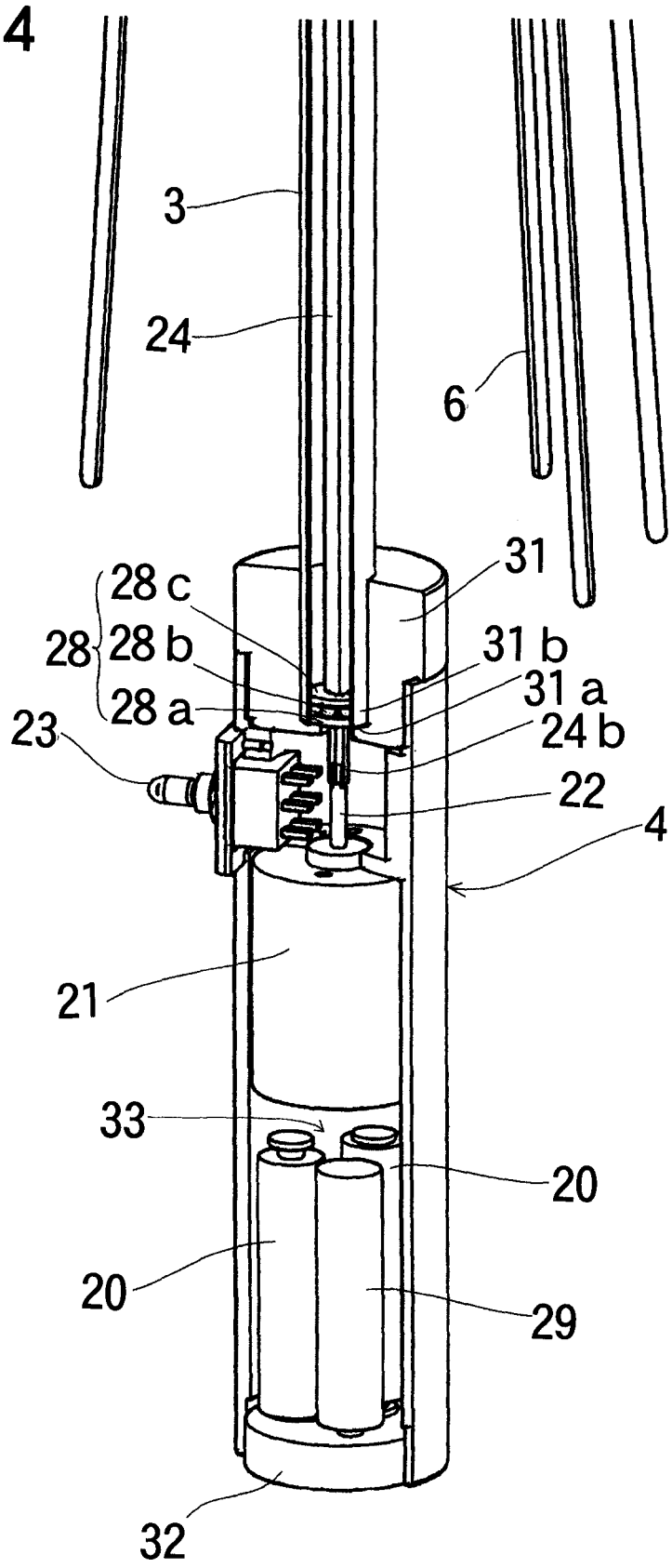
FIG. 4 is the enlarged substantial longitudinal perspective view showing the lower part of the motor-operated umbrella showing.

In addition, as shown in FIG. 4, the battery cell space 33 capable of storing the spare battery cell 29 is arranged at the space inside the handle 4. A reason for this arrangement consists in the fact that when battery cell 20 is out of energy, a battery cell space lid 32 is opened at once and the consumed battery cell can be replaced with the spare battery cell 29. Further, a replacement of the consumed battery cells 20 with the spare battery cell 29 can also be carried out for changeover the consumed battery through an operation of the changeover switch arranged in the changeover circuit if the changeover circuit for use in connecting the spare battery cell 29 with battery cells 20 is arranged in such a way that they can be changed over.

Figure 5:
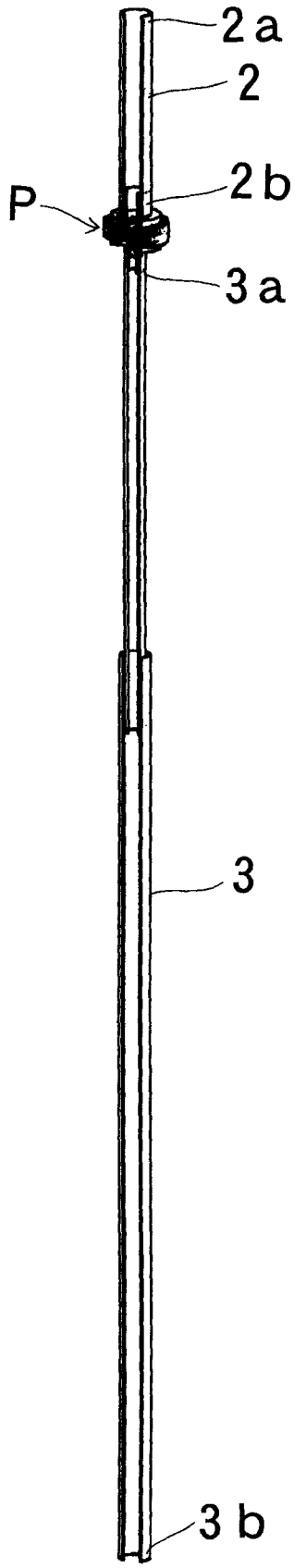
FIG. 5 is the longitudinal perspective view showing the middle shaft.

In FIG. 5, the middle shaft 1 is divided into the upper middle shaft 2 and the pipe-type lower middle shaft 3 at a position that becomes slightly higher than that of the supporting rib holder 8 being as the full-open state of the umbrella.

Figure 2:
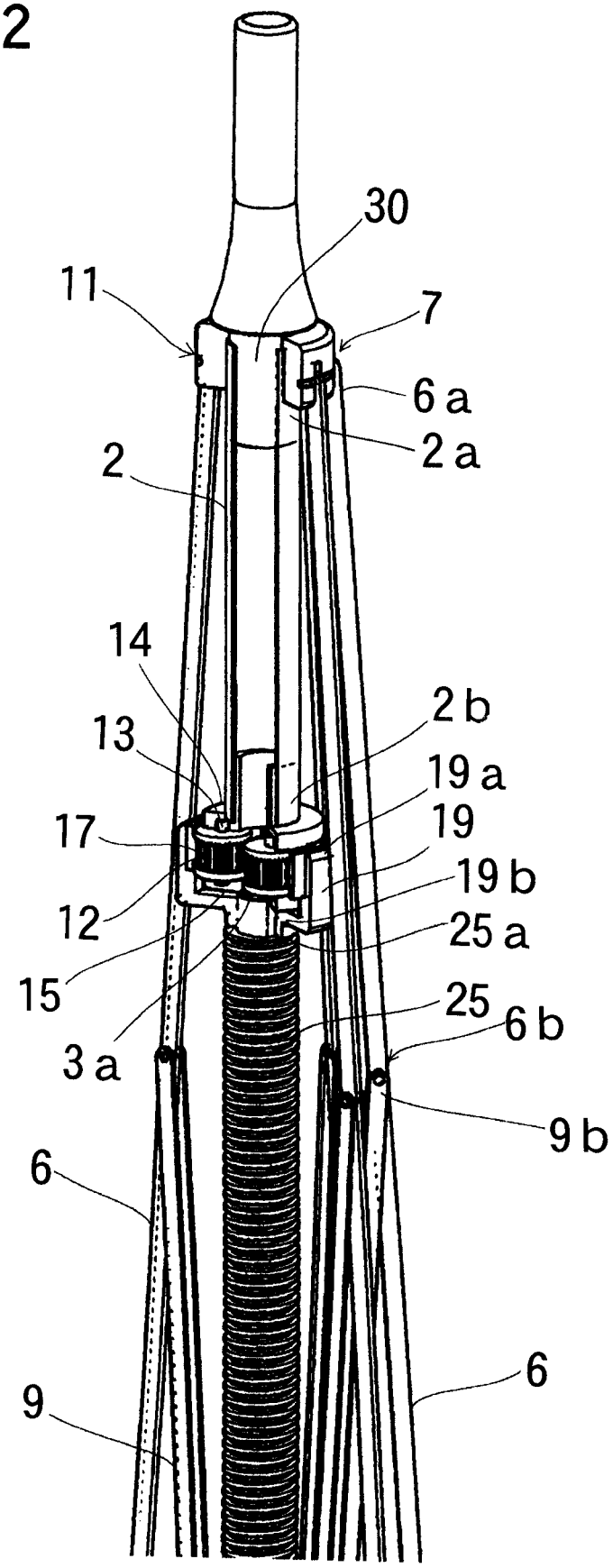
FIG. 2 is the enlarged substantial longitudinal perspective view showing the upper part of the motor-operated umbrella showing.
Figure 8:
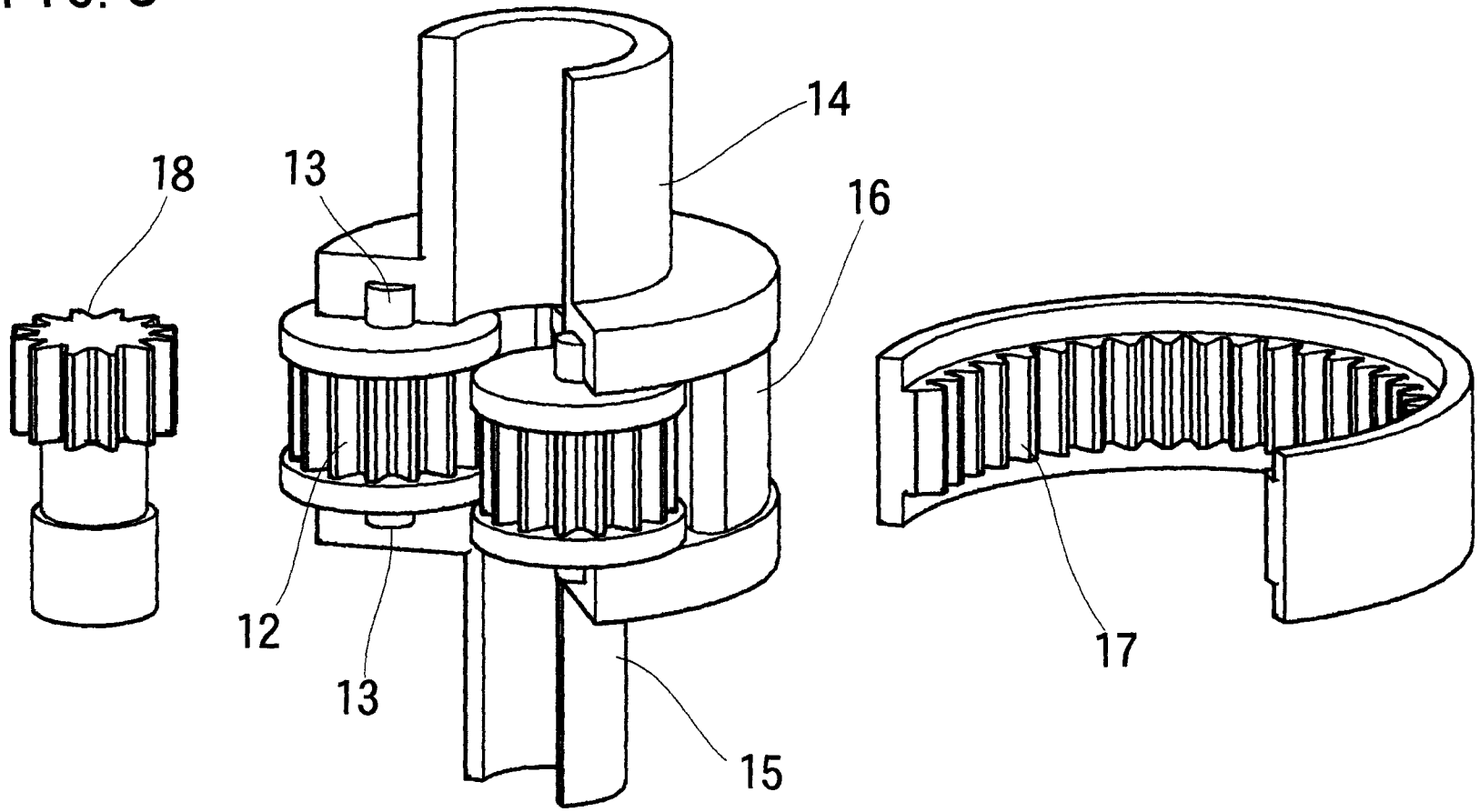
FIG. 8 is the substantial longitudinal perspective view showing the planetary gear mechanism.

As shown in FIG. 2 and FIG. 8, the planetary gear mechanism P comprising the sun gear 18, the planetary gears 12 around the sun gear 18 and the internal gear 17 outside the planetary gears 12 having three same diameters, is arranged at the divided position.

In FIG. 8, the planetary gear mechanism P comprises that planetary gear axles 13 is fixed between an upper supporter 14 and a lower supporter 15, and fitted to the planetary gears 12 as the upper supporter 14 and the lower supporter 15 are strongly fixed to three planetary carrier poles 16.

As shown FIG. 8, shows planetary carrier system consists of three planetary gears 12 are supported by the planetary gear axles 13 between the upper supporter 14 and the lower supporter 15, and the carrier poles 16 is fixed to the upper supporter 14 and the lower supporter 15.

As the sun gear 18 is fitted to the central of planetary carrier system, and the internal gear 17 is fitted around the planetary gears 12, those are composes of the planetary gear mechanism P.

Figure 7:
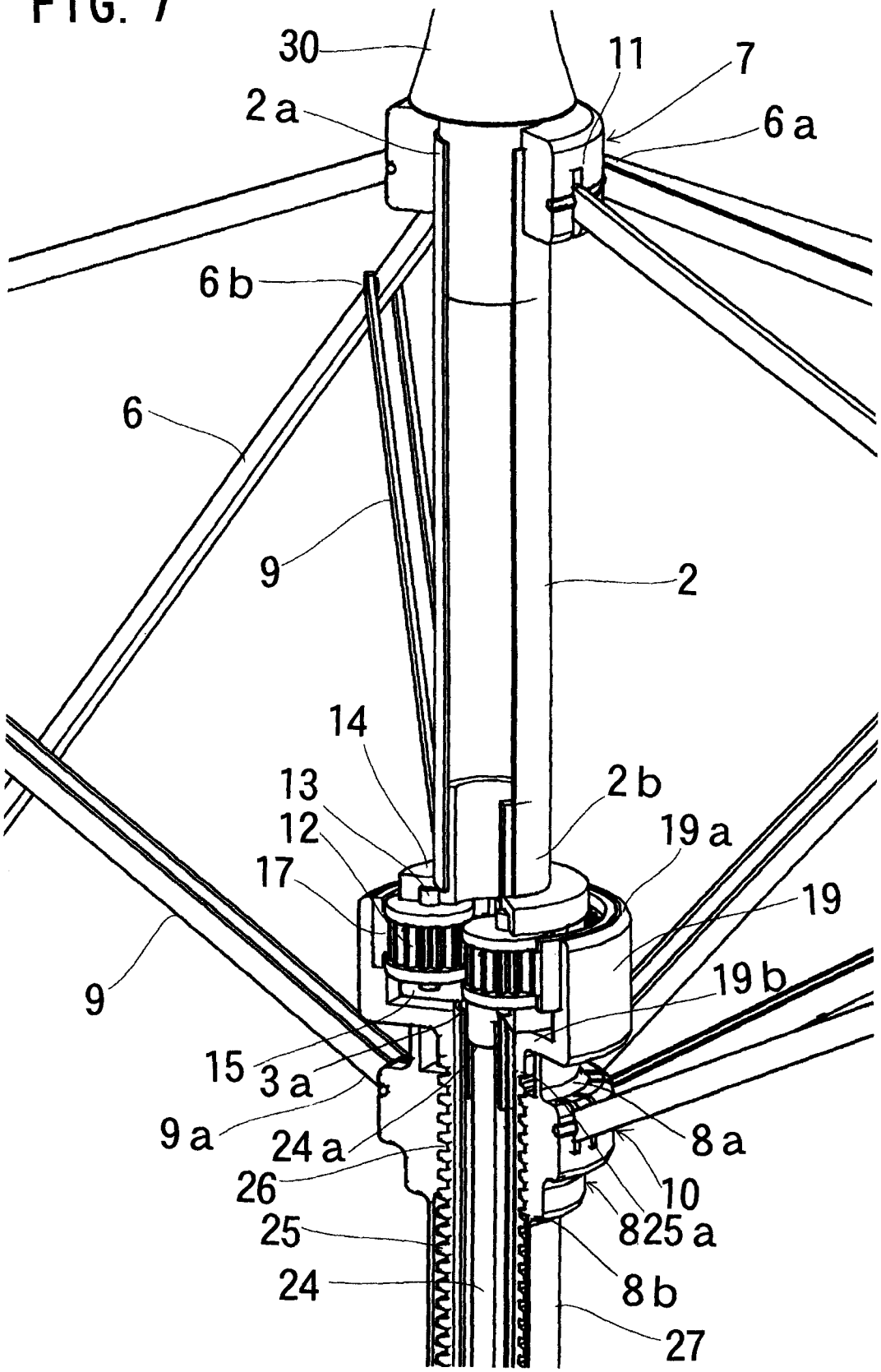
FIG. 7 is the longitudinal perspective view showing the parent rib holder and the supporting rib holder in FIG. 6.

In FIG. 2 and FIG. 7, the upper supporter 14 is fixed to a lower end 2*b* of the upper middle shaft 2 and the lower supporter 15 is fixed to an upper end 3*a* of the lower middle shaft 3. The upper middle shaft 2 and the lower middle shaft 3 are coaxial connected to each other by the upper supporter 14 and the lower supporter 15.

As shown in FIG. 4, a lower end 3*b* of the lower middle shaft 3 is strongly fixed to a middle shaft holding 31 at the upper part of the handle 4.

In addition, the tip part 30 higher than the parent rib holder 7 fixed at an upper end 2*a* of the upper middle shaft 2. As shown in FIG. 7, since the upper middle shaft 2 has no structure in it, so it is also possible to use a rod member other than a pipe.

The driving shaft 24 that formed by rectangular rod or round rod is inserted into the lower middle shaft 3, and a lower end 24*b* of the driving shaft 24 is connected to the motor rotating axle 22 of the motor 21 through the thrust bearing 28 fixed to the middle shaft holding 31 can transmitting the rotation of the motor as shown in FIG. 4.

The lower middle shaft 3 strongly fixed to the middle shaft holding 31 is fixed to the upper part of the handle 4. A step 31*a* for supporting the driving shaft 24 is arranged within the middle shaft holding 31 as a lower end 3*b* of the lower middle shaft 3 is fitted on the step 31*a* as the thrust bearing 28 is fitted into a lower end 3*b* of the lower middle shaft 31.

As shown in FIG. 4, the thrust bearing 28 comprises an upper support plate 28*c*, a lower support plate 28*a*, and a bearing ball 28*b* as put between them to move freely, as the bearing ball 28*b* receives a load of the driving shaft 24 so that the upper support plate 28*c* can be rotate smoothly.

The driving shaft 24 fixed to the upper support plate 28*c* on the thrust bearing 28, the lower end 24*b* of the driving shaft 24 passes through the lower support plate 28*a* and connected to the motor rotating axle 22 of the motor 21.

The upper end of the motor rotating axle 22 is made such that a horizontal section is formed into a square shape, the lower end 24*b* of the driving shaft 24 is made such that its horizontal section has a square hole into which the upper end of the motor rotating axle 22 can be freely fitted because the rotation of the motor 21 can transmit to the driving shaft 24.

That is, the middle shaft holding 31 receives a load applied to the thrust bearing 28. Then, the middle shaft holding 31 receives a load directed toward the motor rotating axle 22 of the motor 21 from the driving shaft 24, to prevent a load from the motor rotating axle 22 to the motor 21. Thereby the rotatory power of the motor 21 is realized maximum.

Then, the sun gear 18 at a position central each of the planetary gears 12 is fixed to the upper end 24*a* of the driving shaft 24 of which position is set through a fixing to the thrust bearing 28.

In addition, the internal gear 17 of planetary gear mechanism P is integrally fixed to the outer cylinder 19 enclosing the internal gear 17 from an upper part 19*a* to a lower part 19*b*. As shown in FIG. 2, the cylindrical male thread 25 for covering the upper part of the lower middle shaft 3 as if a shield within a specific range is fitted with the lower part 19*b* of the outer cylinder 19.

As shown in FIG. 7, the inner peripheral surface of the supporting rib holder 8 is formed with the cylindrical female thread 26 corresponding to the cylindrical male thread 25 and the supporting rib holder 8 is fitted on the cylindrical male thread 25 in such a way that it can move upward and downward. The cylindrical female thread 26 is threadably engaged to the cylindrical male thread 25, and the supporting rib holder 8 is moved upward or downward under the rotation of the cylindrical male thread 25.

A length of the cylindrical male thread 25 from an upper end 25*a* to a lower end 25*b* is set such that the umbrella-sheet 5 can be opened or closed from its completely closed state (shown in FIG. 1) to its full-open state (shown in FIG. 6), when the supporting rib holder 8 is moved upward or downward under the rotation of the cylindrical male thread 25.

Although a length of the cylindrical male thread 25 is not preferable due to the fact that if the length is short, the umbrella cannot be sufficiently closed, but stopped under its semi-opened state. In turn, when the length is little bit longer, trouble in practical use is scarcely found due to the fact that its automatic stop should be carried out at the limit of the opened umbrella and the limit of the closed umbrella.

In addition, when a pitch of the cylindrical male thread 25 is set small, a lot a small sized and light weight the motor 21 can be used and a light weight of the entire umbrella can be realized.

However, when the pitch is excessively small, a speed of opening or closing of the umbrella is made slow, so that it becomes convenient in use of the umbrella if a pitch of the cylindrical male thread 25 is set to such a degree as one in which the umbrella can be fully opened within about three seconds.

In addition, a sectional shape of the thread each of the cylindrical male thread 25 and the cylindrical female thread 26 is preferably a trapezoid can be a smooth rotation of the screw to be attained and an axial large thrusting force to be attained with a relative small moment.

Figure 3:
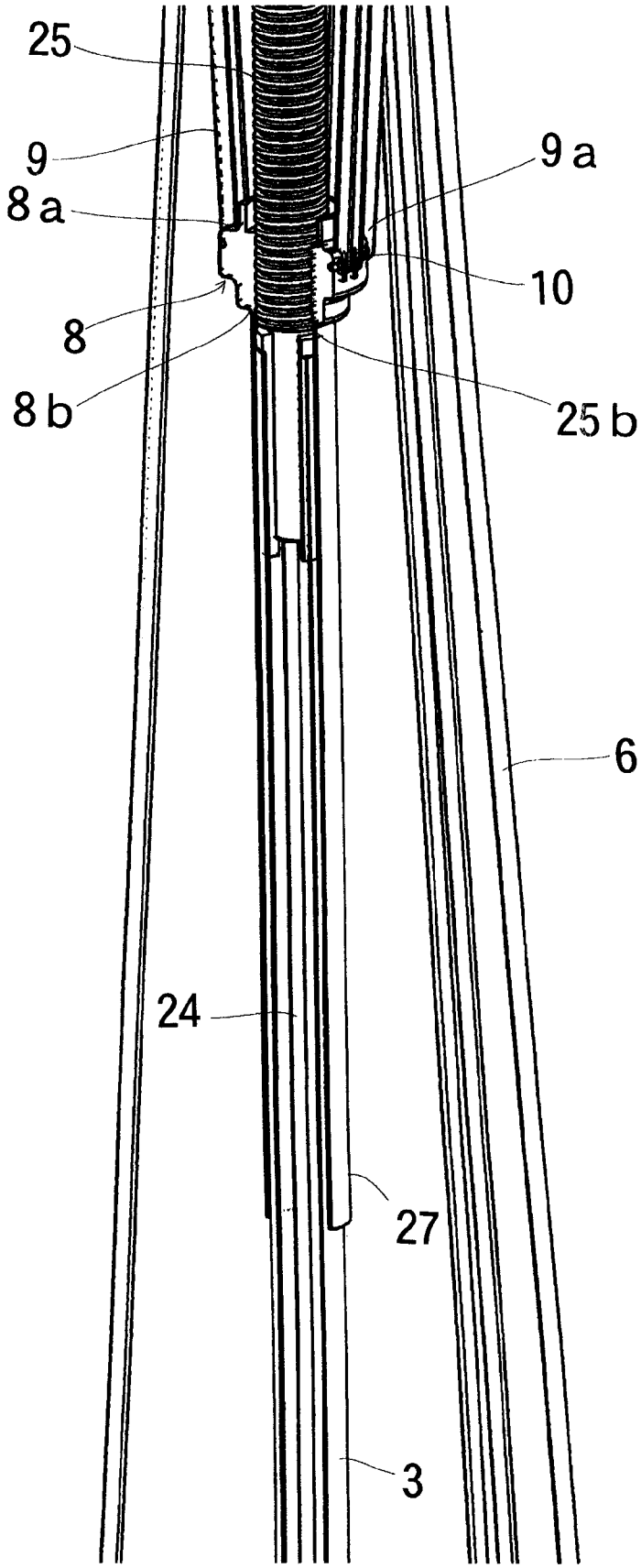
FIG. 3 is the enlarged substantial longitudinal perspective view showing the middle part of the motor-operated umbrella showing.
Figure 9A:
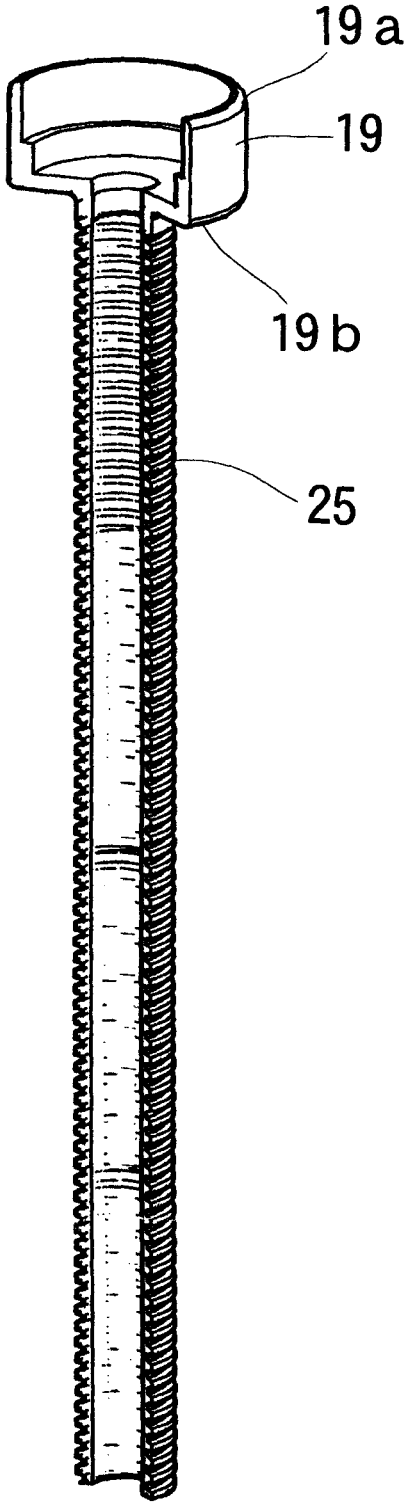
FIG. 9A is the longitudinal perspective view showing the cylindrical male thread is fitted with the outer cylinder.
Figure 9B:
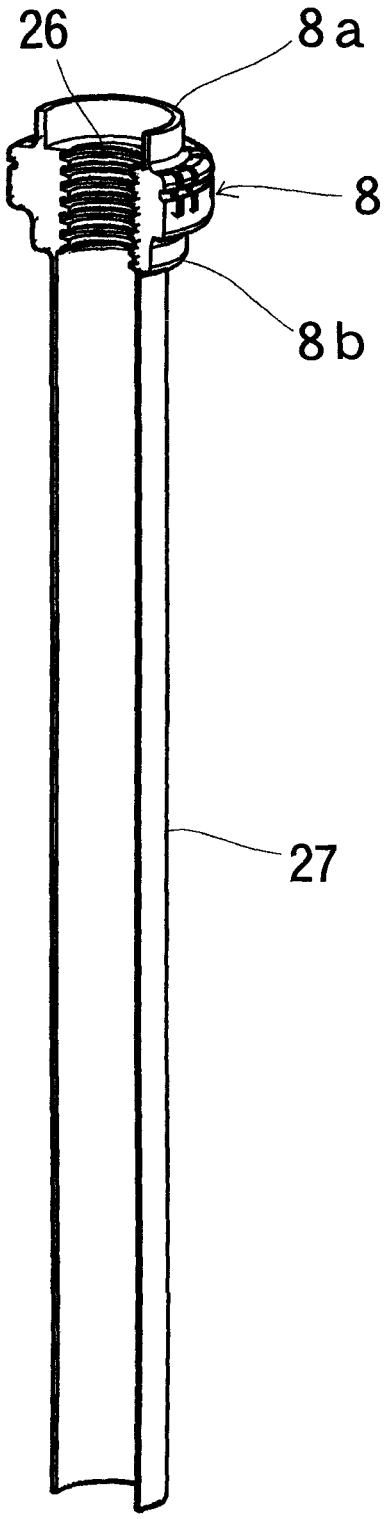
FIG. 9B is the longitudinal perspective view showing the male thread cover pipe is fitted with the supporting rib holder.

Further, as shown in FIG. 3 and FIG. 9B, the male thread cover pipe 27 having such a length as one covering the entire cylindrical male thread 25 is integrally fitted with the lower part 8*b* of the supporting rib holder 8.

This male thread cover pipe 27 itself does not have any direct relation with a function of opening or closing of the umbrella, and when it covers and hides the entire cylindrical male thread 25 and a user holds the upper part of the lower middle shaft 3, it makes to prevent from a user direct holding of the cylindrical male thread 25 and further prevent clothes or hairs from being rolled into it. In addition, the umbrella's design makes simple for the male thread cover pipe 27 hiding the cylindrical male thread 25.

In addition, as shown in FIG. 5, the upper part of the lower middle shaft 3 with a range covered by the cylindrical male thread 25 is formed to have a smaller diameter than that of the lower part of the lower middle shaft 3.

In order to attain this small diameter portion, although a method for connecting a small-diameter pipe and a method for fine drawing are present, any type of methods can be applied.

A length of the upper part of the lower middle shaft 3 corresponds to a length of range covered by the cylindrical male thread 25.

Due to this fact, if the upper part of the lower middle shaft 3 is formed to have a small diameter, a diameter of the cylindrical male thread 25 is fitted to the outside part of the upper part of the lower middle shaft 3 and a diameter of the male thread cover pipe 27 is fitted to the further outside can also be formed to a smaller diameter.

The principle of opening or closing of the umbrella is explain as operation for opening or closing of the umbrella described as follows:

When users hang on the handle 4 in a hand and the switch 23 is turned on, the motor 21 connecting with the battery cells 20 is rotated.

The motor 21 is rotated in a counterclockwise direction, the sun gear 18 is rotated under a rotation of the driving shaft 24, the planetary gears 12 is rotated in a clockwise direction under a rotation of the sun gear 18 and the internal gear 17 is rotated in a clockwise direction under a rotation of the planetary gears 12. The cylindrical male thread 25 is fitted with the outer cylinder 19 is rotated in a clockwise direction under a rotation of the internal gear 17.

Then supporting rib holder 8 threadly engaged with the cylindrical male thread 25 by the cylindrical female thread 26 is supported immovably by the supporting ribs 9 through the parent ribs 6, so that the supporting rib holder 8 is moved upward under a clockwise rotation of the cylindrical male thread 25 and the supporting ribs 9 push up the parent ribs 6 to cause the umbrella-sheet 5 to be opened and the umbrella is fully opened.

When the switch 23 is turned off intermittently, the motor 21 is stopped and the umbrella have been keeping semi-open state as shown in FIG. 10 as the users try to open the umbrella, they cannot open it because the cylindrical male thread 25 and the female thread 26 of the supporting rib holder 8 are threadly engaged each other.

If the battery cells 20 consume, the users change battery cells 20 for the spare battery cell 29 because of semi-open state condition will dissolve.

The raising of the supporting rib holder 8 is stopped when the upper part 8*a* of the supporting rib holder 8 reaches to the lower part 19*b* of the outer cylinder 19 as the umbrella is fully opened as shown in FIG. 6, so the users turn off the switch 23.

The switch 23 is turned on under the full-opened state of the umbrella, the motor 21 is rotated a clockwise direction, and the supporting rib holder 8 is moved downward under a counterclockwise rotation of the cylindrical male thread 25, and the supporting rib 9 pull down the parent rib 6 to cause the umbrella-sheet 5 to be folded as shown FIG. 1.

The lowering of the supporting rib holder 8 is stopped when the umbrella is completely closed, so the users turn off the switch 23.

Under this condition, the users try open the umbrella, cannot open it because the cylindrical male thread 25 and the cylindrical female thread 26 of the supporting rib holder 8 are threadly engaged each other, and the umbrella is kept at its folded and closed state as it is, so that the user can hold it easily on an umbrella stand.

In addition, according to this invention, if the middle shaft is made short in its length and the parent ribs are folded into three segments, a length of the parent ribs when the umbrella is closed becomes short by a length corresponding to the folded segment, so that it becomes also possible to make a substantial short length of the entire length of the umbrella when the umbrella is closed.

This umbrella can use broadly for in a rain day, a sunny day, at a sea side or a cafe for a parasol or a sunshade, etc.

| | | |
|---|---|---|
| middle shaft 1 | | |
| upper middle shaft 2 | upper end 2a | lower end 2b |
| lower middle shaft 3 | upper end 3a | lower end 3b |
| handle 4 | | |
| umbrella-sheet 5 | | |
| parent(=outer) ribs 6 | base ends 6a | central parts 6b |
| parent rib holder 7 | | |
| supporting rib holder 8 | | |
| supporting ribs(=stretcher)9 | base ends 9a | end parts 9b |
| supporting rib(=stretcher) joints 10 | | |
| parent rib joints: 11 | | |
| 12-16 consists of planetary carrier system | | |
| the planetary gears 12 | | |
| the planetary gear axles 13 | | |
| upper supporter 14 | | |
| lower supporter 15 | | |
| planetary carrier pole 16 | | |
| internal gear 17 | | |
| sun gear 18 | | |
| P = planetary gear mechanism | | |
| outer cylinder 19 | upper part 19a | lower part 19b |
| battery cells 20 | | |
| motor 21 | | |
| motor rotating axle 22 | | |
| switch 23 | | |
| driving shaft 24 | upper end 24a | lower end 24b |
| cylindrical male thread 25 | upper end 25a | lower end 25b |
| cylindrical female thread 26 | | |
| male screw cover pipe 27 | | |
| thrust bearing 28 | | |
| lower support plate 28a | the bearing ball 28b | |
| upper support plate 28c | | |
| a spare battery cell 29 | | |
| tip part 30 | | |
| middle shaft holding 31 | a step 31a | |
| battery cell space lid 32 | | |
| battery cell space 33 | | |
| | thread = spiral ridge | |

The invention claimed is:

1. A motor-operated umbrella characterized in that battery cells and a motor are installed at a space inside of a handle of an umbrella, and a changeover switch is arranged on electric wires for connecting the motor and the battery cells;

a middle shaft that is divided into an upper middle shaft and a pipe-type lower middle shaft at a position that is slightly higher than that of a supporting rib holder under the full-opened state of the umbrella, a planetary gear mechanism comprising a central sun gear, planetary gears around the sun gear and an internal gear outside the planetary gears is arranged at the divided position, an upper supporter is connected to the upper middle shaft and fixed to an upper part of a planetary carrier pole installed within the planetary gear mechanism, a lower supporter is connected to the lower middle shaft and fixed to a lower part of the planetary carrier pole installed within the planetary gear mechanism, and the upper middle shaft and the lower middle shaft are coaxial connected to each other to form a fixed shaft;

a driving shaft is inserted into the lower middle shaft, and a lower end of the driving shaft is connected to a motor rotating axle of the motor through a thrust bearing fixed to an upper part of the handle for transmitting a rotation of the motor, and at the same time an upper end of the driving shaft is fixed to the sun gear;

the internal gear is fixed to an outer cylinder, a cylindrical male thread covering an upper part of the lower middle shaft as a shield is fitted with a lower part of the outer cylinder, and an inner peripheral surface of the supporting rib holder is formed with a cylindrical female thread corresponding to the cylindrical male thread, and a male thread cover pipe having such a length as one covering entire of the cylindrical male thread is fitted with the supporting rib holder.

2. The motor-operated umbrella according to claim 1, wherein the upper part of the lower middle shaft in a range covered by the cylindrical male thread is formed to have a smaller diameter than that of the lower part of the lower middle shaft.

3. The motor-operated umbrella according to claim 1, wherein a battery cell space capable of storing a spare battery cell is arranged at the handle of the umbrella and the spare battery cell is stored in the battery cell space.

* * * * *